United States Patent [19]

Campbell

[11] 4,197,807

[45] Apr. 15, 1980

[54] COLLAPSIBLE TRAFFIC CONE MARKER

[76] Inventor: Bruce E. Campbell, Pittville Rte., McArthur, Calif. 96056

[21] Appl. No.: 918,591

[22] Filed: Jun. 23, 1978

[51] Int. Cl.[2] ..... E01F 9/01

[52] U.S. Cl. ..... 116/63 P; 40/610; 350/97; 404/11

[58] Field of Search ..... 116/63 P, 63 C; 40/593, 40/591, 592, 606, 610, 584, 489; 404/10, 11; 52/103; 248/160; 350/97

[56] References Cited

U.S. PATENT DOCUMENTS

| | | | |
|---|---|---|---|
| 2,610,548 | 9/1952 | Isenberg | 350/97 |
| 2,954,005 | 9/1960 | Cioffi et al. | 116/63 C |
| 3,520,235 | 7/1970 | Palazzolo et al. | 404/11 |
| 3,618,556 | 11/1971 | Dittrich | 404/11 |
| 3,707,320 | 12/1972 | Brynes | 116/63 C |
| 4,006,702 | 2/1977 | St. Cyr | 116/63 P |
| 4,055,840 | 10/1977 | Uchytil et al. | 350/101 X |

FOREIGN PATENT DOCUMENTS

| | | | |
|---|---|---|---|
| 281183 | 12/1927 | United Kingdom | 404/11 |

*Primary Examiner*—Daniel M. Yasich
*Attorney, Agent, or Firm*—Blair, Brown & Kreten

[57] ABSTRACT

Disclosed herein is a collapsible traffic cone marker characterized by a cylindrical base portion having one open face, an upwardly extending spiral reflective marker capable of collapsing and nesting within the base portion, and a bolt mechanism which can retain the spiral reflector within the casing when actuated or when released can allow the spiral spring to extend upwardly thereby approximating a conventional conical traffic marker.

2 Claims, 3 Drawing Figures

COLLAPSIBLE TRAFFIC CONE MARKER

BACKGROUND OF THE INVENTION

The use of conical shaped traffic markers is quite evident in modern society, and those familiar with such a conical type marker are aware of the nesting technique used in storing these cones: placing one on top of the other. It is readily apparent however that using such a storage technique, the most judicious use of space in the vehicle that carries these markers is not possible since there is considable amount of wasted space defined by the length between the base or support structure of the cone and the tip thereof.

Further however these markers are plagued by the problems associated with their use in heavy traffic whereby portions of the marker have been deformed beyond the elastic limits of the material from which it is molded or in an extreme instance portions of the cone have been shredded off. In these instances it will be appreciated that the nesting technique is not necessarily a simple manual chore.

SUMMARY OF THE INVENTION

Accordingly, it is an object of this invention to provide a traffic marker which is collapsible and therefore lends itself to greater storage of space.

Another object of this invention comtemplates providing a conical reflector structure which is easily collapsible.

Another object of this invention contemplates providing a conical reflector which is durable and easy to transport in the collapsed condition.

These and other objects will be made manifest when considering the following detailed specification and claims.

DESCRIPTION OF THE PREFERRED EMBODIMENT

Figure 1:
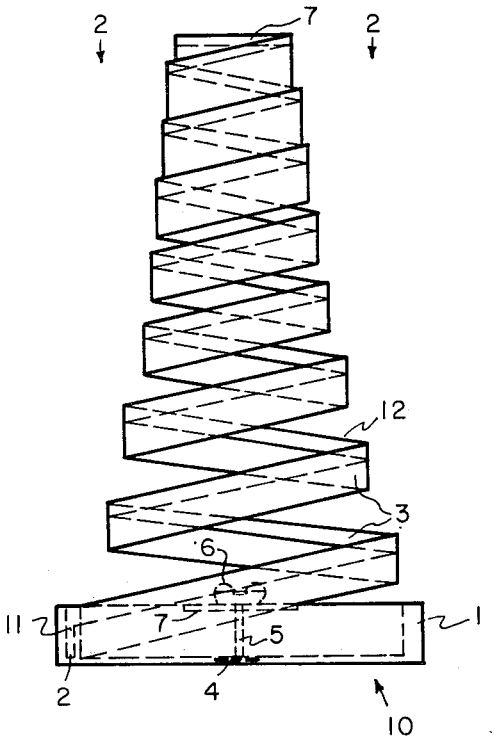
FIG. 1 is a side view of the apparatus in it's extended form.
Figure 2:
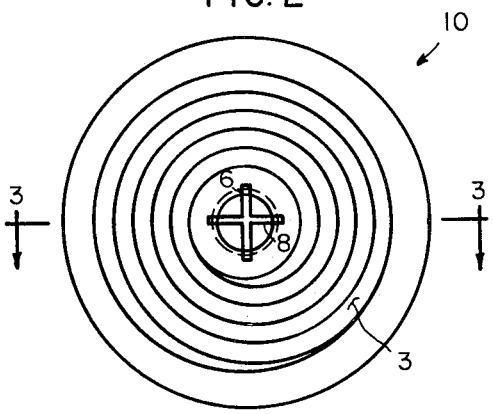
FIG. 2 is a top plan view thereof.

Referring to the drawings now wherein like reference numerals refer to like parts throughout the several drawings reference numeral 10 is generally directed to the conical reflector according to the present invention.

This conical reflector has a generally cylindrical base portion 1 with one open side—that side being the top side, and a means defining an opening 11 for reception therein of a pronged element 2 which serves as the spring support for the expandable reflector portion 3 and defines selectively moveable means.

Figure 3:
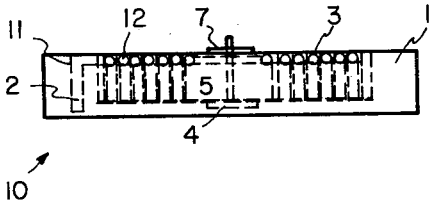
FIG. 3 is a side sectional view taken along lines 3—3 of FIG. 2.

This reflector portion 3 can generally be regarded as a spiral or conical type design of ever decreasing radius so that the top most portions nest within the adjacent lower portions downwardly to the point that they are collapsible and fall within the confines of the open faced cylinder 1. Reinforcing rib 12 serves as the support and resilience which causes the expandable reflector 3 to assume a conical configuration and also allows itself to be compressed into the cylinder 1. FIG. 1 and FIG. 3 each show a retention device comprising a horizontally disposed retention element 4 connected to a vertically upstanding rod member 5 centrally disposed and contained within the cylinder 1 and thereafter terminates in a threaded end portion adapted to receive in the preferred embodiment a wing nut 6. Directly underlying wing nut 6 is a circular retention plate whose function will now be described in detail.

FIG. 1 shows the circular disk 7 in phantom at the lower portion of the drawing when the conical reflector is in the expanded state and solid configuration along the top portion thereof in FIG. 3.

When the top most portion of the conical reflector is compressed as shown in FIG. 3, the wing nut can be rotated to slide through groove 8 or alternatively can be disposed at an angle thereto so as to resist the spring force imposed by rib element 12 in the reflector. Therefore, when the slit 8 is not in registry with the wing nut 6, the reflector is constrained in the downward position. When the wing nut 6 is in registry with slip 9 however the circular disk is allowed to pass over the wing nut and therefore the spiral is allowed to open up and be deployed.

Having thus described the invention it will be apparent that for optimum results the outer surface of the spiral 3 is made of a material that reflects light such as a day glow orange color, but is not limited thereto. Further it will be apparent that numerous structural modifications are contemplated as being a part of this invention as set forth hereinabove and as defined by the claims.

What is claimed is:

1. A collapsible portable traffic cone marker comprising:

a base of cylindrical configuration having an open top face, a opening disposed along an edge of said open top face, a resilient rib defining a spiral having one end placed in said opening, by selectively moveable means, said rib having a resilient memory which causes said rib to extend upwardly released by said moveable means, said resilient rib having a second end fixed in said base and defining a generally conical shape, a reflector depending from and fastened to said rib along its entire length whereby when said rib is free standing, said reflector is deployed therewith and thereby forms a marker which allows air to pass therethrough, said selectively moveable means is spaced from a bottom face of said base for retaining said rib and reflecting portions in said base in which said selectively moveable means for retaining said rib and reflecting portions in said base comprises:

a horizonally disposed bar on the bottom face of said base, said selectively moveable means including a vertically upstanding rod member fastened to said bar substantially at said bar's center and extending through said base having a threaded terminal portion above said base, a substantially circular plate of said moveable means at a top most portion of said rib remote from said fixed one end, said plate having an elongate linear slit disposed therethrough, and a wing nut threaded on said threaded terminal portion of said rod member, whereby when said plate is pushed over said wing nut, through said slit, said wing nut can be rotated away from registry with said slit and said marker has been compressed for storage.

2. The device of claim 1 in which said reflector is coated with a day glow material.

* * * * *